US010779573B2

(12) United States Patent
Rose

(10) Patent No.: US 10,779,573 B2
(45) Date of Patent: Sep. 22, 2020

(54) CONJUNCTIVE AIRFLOW ATOMIZER FOR CONCENTRATES

(71) Applicant: Sai Stephen Rose, McKinleyville, CA (US)

(72) Inventor: Sai Stephen Rose, McKinleyville, CA (US)

(73) Assignee: George John Sarlas, Lisle, IL (US)

( * ) Notice: Subject to any disclaimer, the term of this patent is extended or adjusted under 35 U.S.C. 154(b) by 0 days.

(21) Appl. No.: 15/605,952

(22) Filed: May 26, 2017

(65) Prior Publication Data

US 2019/0380387 A1 Dec. 19, 2019

(51) Int. Cl.
*A24F 47/00* (2020.01)
*A24F 1/02* (2006.01)
(Continued)

(52) U.S. Cl.
CPC ..... *A24F 47/008* (2013.01); *A24F 1/02* (2013.01); *A24F 7/00* (2013.01); *H05B 3/03* (2013.01);
(Continued)

(58) Field of Classification Search
CPC . A24F 1/02; A24F 7/02; A24F 47/008; H05B 3/06; H05B 3/44; H05B 2203/021; A61M 11/042; A61M 15/06
See application file for complete search history.

(56) References Cited

U.S. PATENT DOCUMENTS 9,132,248 B2 * 9/2015 Qiu ..... A61M 11/041
2011/0011396 A1 * 1/2011 Fang ..... A24F 47/008 128/202.21
(Continued)

*Primary Examiner* — Ryan A Reis

(57) ABSTRACT

An atomizer for vaporizing concentrated substances wherein a conjunctive airflow system located at the lower portion of the atomizer, which when attached to a regulated power source by the industry standard, universal 510 thread system, allows a user to inhale vapor from a mouthpiece. During inhalation air is drawn through a conjunctive airflow system wherein the temperature of the ambient air is conditioned and is drawn into the replacement atomizer through a plurality of air holes through the ceramic heating chamber and then through the exhaust holes of the ceramic heating chamber. As air enters the ceramic heating chamber, it passes around a coil. The coil is a smaller gauge coil than used in the industry and was achieved by converting the coil to have larger gauge leads. As air enters the narrowed ceramic heating chamber it passes around the coil to regulate the temperature of the coil and also to draw the vapor into the reclaim safety cap, where the splatter is captured by the reclaim safety cup to be re-used and the vapor travels around the cup through the plurality of slots around the reclaim safety cup and enters the mouthpiece drip tip and is then inhaled by the user. The conjunctive airflow system is designed to manipulate the temperature in order to enhance the vaping experience. The user can simply separate the conjunctive airflow system from the mouthpiece and the reclaim safety cap and replacement atomizer and pre-cool the conjunctive airflow base and the reclaim safety cap and place them near a cooling source such as an air conditioning unit, refrigerator, or freezer to cool the vapor.

14 Claims, 11 Drawing Sheets

(51) Int. Cl.

| | |
|---|---|
| ***H05B 3/06*** | (2006.01) |
| ***H05B 3/44*** | (2006.01) |
| ***A24F 7/00*** | (2006.01) |
| ***H05B 3/03*** | (2006.01) |

(52) U.S. Cl.
CPC ..... *H05B 3/06* (2013.01); *H05B 3/44* (2013.01); *H05B 2203/021* (2013.01)

(56) References Cited

U.S. PATENT DOCUMENTS

| | | | | |
|---|---|---|---|---|
| 2013/0213419 | A1* | 8/2013 | Tucker | H05B 3/0014 131/328 |
| 2015/0157055 | A1* | 6/2015 | Lord | H05B 3/16 131/329 |
| 2016/0073692 | A1* | 3/2016 | Alarcon | A24F 47/008 131/329 |
| 2016/0219937 | A1* | 8/2016 | Rado | A24F 47/008 |
| 2017/0049153 | A1* | 2/2017 | Guo | A24F 47/008 |

* cited by examiner

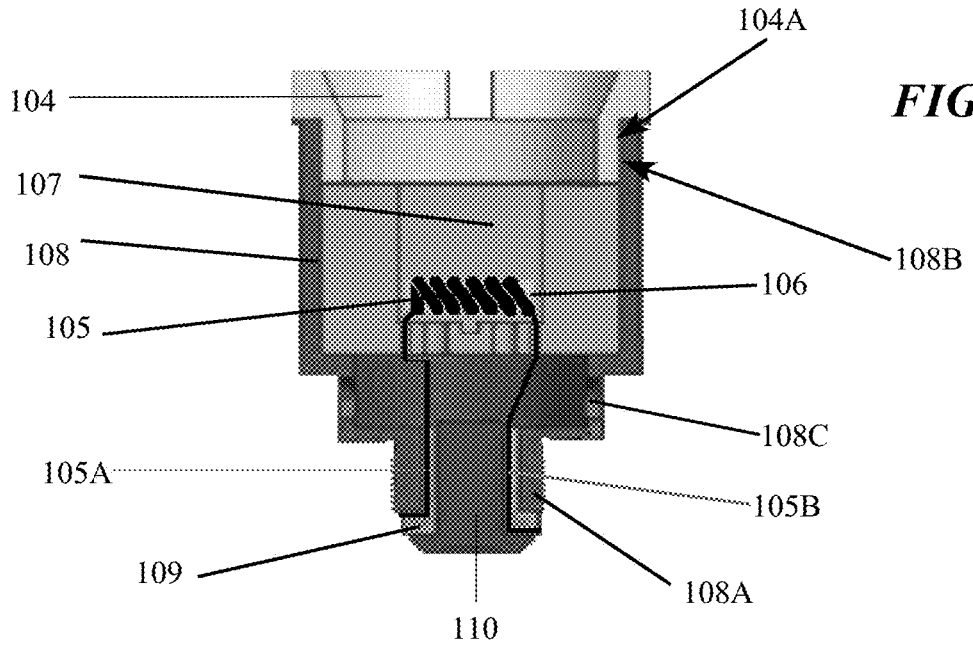
FIG. 5
FIG. 7
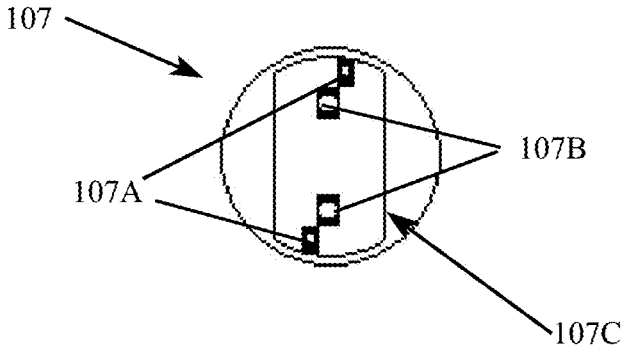
FIG. 6
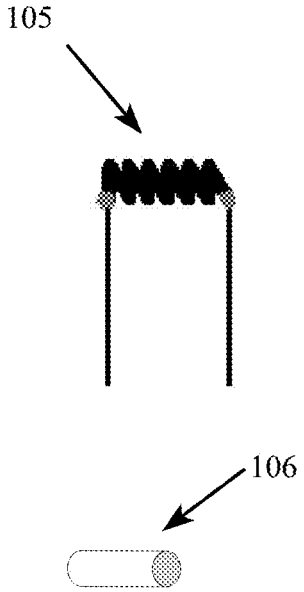
FIG. 8
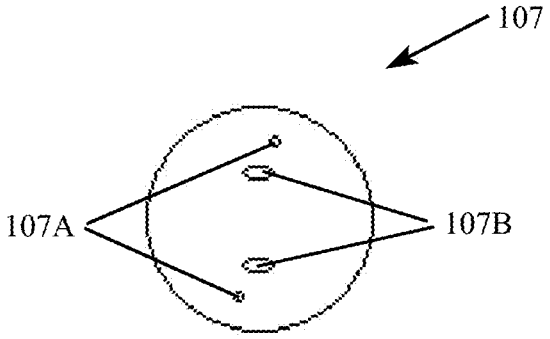

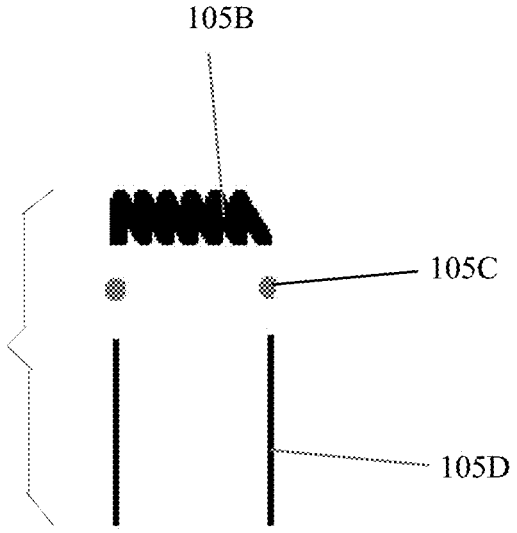
*FIG. 9*
*FIG. 10*
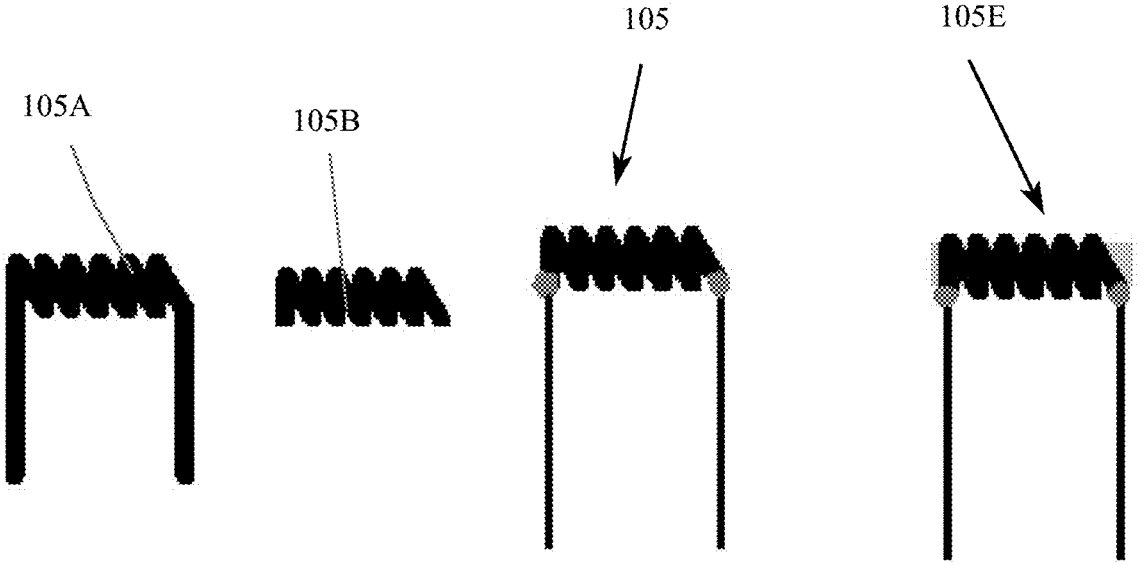

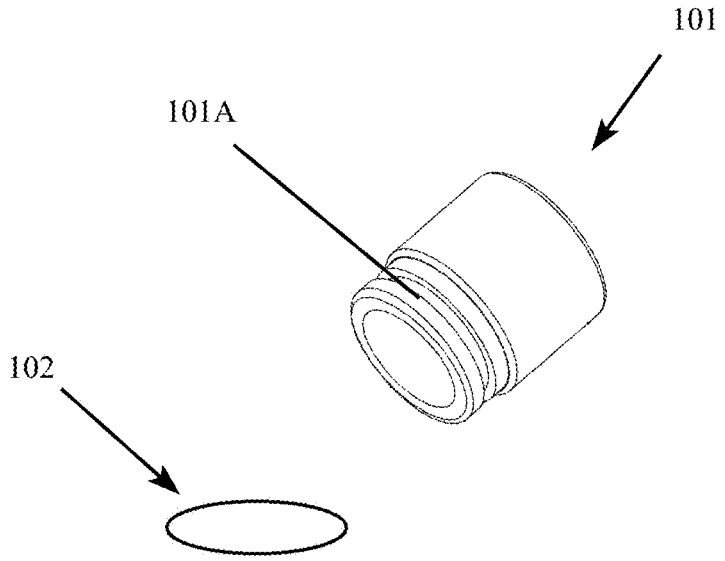
*FIG. 15*
*FIG. 16*
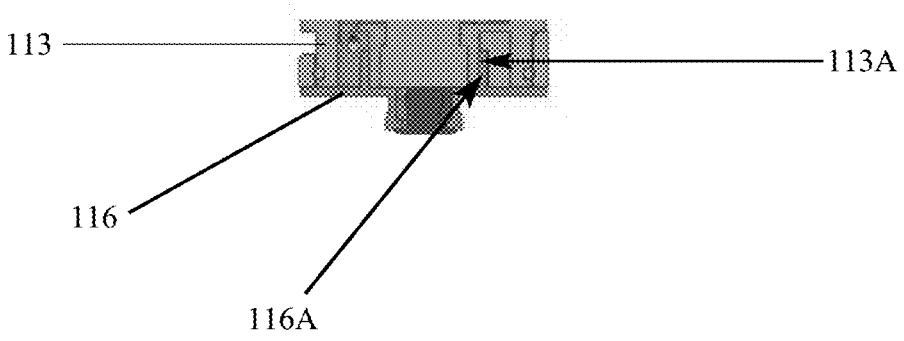

CONJUNCTIVE AIRFLOW ATOMIZER FOR CONCENTRATES

PRIORITY CLAIM

This application claims priority to U.S. Provisional Application No. 62/326,504, filed May 25, 2016 in the name of the inventor Sai Stephen Rose.

BACKGROUND OF THE INVENTION

Recent studies show that it is preferable for humans to inhale the vapor of both dry herbs concentrates, and substances developed for vaporizing versus the inhalation of the combustion and smoke of these substances. The chemicals released from the substances change based upon the temperature of the heating coil, and the health detriments of smoking are well-known and avoided by vaporization. Some user's have stomach conditions which do not allow them to digest oral substances and physician's recommend vaporizing as a safer alternative.

Vaporization is the process by which a substance is converted from a solid state into to a vapor by the application of heat.

Increased demand for the vaporization of solid substances has created a market for devices to effectively and safely vaporize such substances as tobacco, concentrate substances, and other herbs in both a wet and a dried state, with both health and delivery being a priority.

Devices that vaporize these substances are known as atomizers which is the non-proprietary name in the art for a device that comprises all of the components necessary to vaporize substances. Atomizers require a connection, usually threaded, to a regulated power source in order to activate the heating coil found in the atomizer. The power source provides power to the heating coil, thereby allowing the coil to vaporize substances that it comes in contact therewith.

There are two main types of heat transfer currently best-known for vaporization. These are conduction and convection. Conduction heat transfer is heating of a medium through direct contact so that the heating coil transfers heat directly to the substance in direct contact therewith. In convection heating, air passes through a heating element which is heated to the desired temperature and the heated air is passed through the material to be vaporized. The present device uses the conduction method by heating the organic substance through direct contact with the heating coil.

Atomizers for herbs and concentrates comprise a cup shaped structure of non-conductive materials, in which there is disposed a tightly wound heating coil into which coil a heating rod is inserted. The heating coil is the surface onto which the dry herb, concentrate, or other substance can be placed. Atomizers typically include a detachable mouthpiece cap that can be removed to provide access to the heating coil so that a user can place substances directly onto the heating coil.

SUMMARY OF THE INVENTION

There is a need in the art for improved vaporization and safety in the use of atomizers since they heat substances to temperatures exceeding 400 degrees Fahrenheit. There is a need in the art to be able to capture the unused substance during the vaporization. There is a need in the art to enable different chemicals to be released from the substance. There is a need in the art for an increased amount of airflow which is adjustable. There is a need in the art for pre-conditioning the air that flows to the heating coil. There is a need in the art for a larger heating coil surface on which to apply the substance to increase the quantity of vapor without having to overheat the coil. There is a need in the art for a heating chamber that is more efficient. All of these needs of the art are filled by the device of this invention.

FIELD OF THE INVENTION

The device described herein relates to vaporizing devices which heat substances to a temperature whereby vapors are produced which are inhaled by the user. The present invention provides enhancements to the vaping experience by increasing the amount of vapor produced by employing a larger than prior art sized coil combined with the adjustable conjunctive airflow system to be described herein.

The invention, once assembled comprises 6 main parts. These are: a mouthpiece drip tip; safety reclaim cap; a removable replacement atomizer; a removable replacement atomizer positive metal pin; a removable conjunctive airflow base; and a conjunctive airflow base positive metal pin.

Enhancements include the implementation of a conjunctive airflow base which allows for increased airflow and the ability to adjust and control the airflow into the heating coil.

Further enhancements include a feature to capture and re-use a portion of the heated substance that may splatter into the recessed cup-like structure in said safety reclaim cup.

Further enhancements include the amount of vapor is increased by having the ability to use a large heating coil and second, by increasing the amount of airflow into the heating coil of the device. Enlarging the size of the coil without increasing the size of the lead wire exit holes of the ceramic heating chamber is unique to this device and is accomplished by replacing the small gauge leads on industry standard oversized coils, followed by welding on larger gauge lead wires so that the smaller gauge wire leads can penetrate the small lead holes in the ceramic heating chamber into which the heating coil is disposed. The second purpose of the larger gauge lead wires is so that the industry standard, universal 510 thread system can be maintained since the lead wires are threaded through the said 510 connector. The use of small lead wire exit holes in the ceramic heating chamber also reduces the common cause of leakage of heated substance into the lower parts of the device which may cause a short.

The present invention further improves on the ceramic heating chamber that holds the heating coil on which a substance is applied, by narrowing two sides of the interior of the ceramic heating chamber along the length of the coil, to further constrict both the substance and the air. The increase in the airflow and the increase in the heating surface creates an increase in the amount of vapor produced without having to provide additional heat to the heating coil from the power source.

Unique to the present invention is the creation of two chambers to deliver incoming ambient air to the heating coil. Conjunctive air flow is an improved method to slowly step up the moving air to a warmer temperature before it reaches the heating coil so that cold air is not introduced directly onto a hot coil, which is too dynamic of a temperature change. Conjunctive airflow is the process by which incoming ambient air is temperature-increased as it fills the first or lower air chamber through a plurality of holes, with the air flow filling the second chamber and warming the air where the air is drawn through a plurality of holes and then filling the replacement atomizer before it reaches the heating coil.

Significant features of the conjunctive airflow system give the user the ability to pre-cool the conjunctive airflow base by removing all removable parts, including the positive metal pin and placing only the conjunctive airflow base and reclaim safety cap in a refrigerator or freeze to pre-cool the device prior to use.

Conversely, users may want to keep the temperature of the vapor low and the conjunctive airflow base has the capability to be pre-chilled/cooled for users who have medical health issues such as chronic obstructive pulmonary disease (C.O.P.D), or individuals who prefer to draw more vapor from one single use, without the additional affects of inhaling more vapor. Previously, to achieve a cooler vapor in a selected device, users have used water or ice or a combination of both to cool vapor or smoke, but those devices are not portable. The present invention was designed to be portable to fit in a pocket and the size limitations would not allow for water or ice to pre-chill the device. In current art, when ambient air is too cool the interior temperature of the device lowers to such a degree that it affects the amount of vapor produced. The development of a device that could be pre-warmed led to the concept that since the present device can be pre-heated, it can also be pre-chilled. In current art, it is the regulated power source that users would have to engage to pre-heat an atomizer, which ultimately drains the batteries of the power source.

The pre-chilling process of the conjunctive airflow base is possible because the device is constructed from stainless steel to retain the temperature of the air when it is transversing through the conjunctive airflow system. The post-chilling of the flow of air is accomplished when the mouthpiece is removed and the safety reclaim cap is chilled, since the safety reclaim cap is also constructed of stainless steel so it would retain the desired temperatures.

The positive metal pin which is located in the inside wall of the threads of the industry standard universal 510 deck was designed to be easily removable, so that when heating or chilling the conjunctive airflow base the temperature of the positive metal pin won't change allowing the positive metal pin to remain at ambient air temperature. The positive metal pin is only removed when heating or chilling at extreme temperatures, because some of the regulated power sources sense the temperature of the electrical system through the positive metal pin and prevents the heating coil from firing until the termperature stabilizes. In the present invention, the assembled conjunctive airflow system was designed to be completely separate from the electrical system so that it doesn't interfere with the firing of the heating coil .

Further adding to the vapor temperature cooling is a suspended cup inside the reclaim safety cap which is positioned to disrupt the air flow so that the vapor remains in the cap for a longer time to additionally chill the vapor. In the present invention, the reclaim cup with 3 slots for the air to be drawn through, also provides a barrier from the direct heat of a coil being too close in proximity to the user's mouth which is a safety feature.

In the art, there are several splash cap designs that act as a barrier to prevent splatter from hitting the user's mouth, but the recessed cup in the reclaim safety cap is an enhancement to collect the splatter after the coil heats the substance in the reclaim cup to be reused. Issues common to the splatter effect include when a user adds more concentrate to the heating coil where any dried residue remains on the heating coil causing a explosive 'pop' where the hardened concentrate mixed with the fresh softer concentrate becomes a safety issue of hot concentrate entering the user's mouth and lips. The reclaim safety cap has reduced the potential for injury.

In the art, the larger the coil, the greater the amount of vapor produced because of a larger heating surface on which to apply the substance. When the device contains a larger coil it creates more heating surface and the ability to better control the temperature, and the user is able to extract the desired chemicals from the substances, which is extremely important for medical purposes, as the user does not have to attain ,higher temperatures from the regulated power source to achieve this. The present embodiment solved two problems in the art: First, smaller gauge coils have a natural lead which is the same size as the coil and the lead holes in the ceramic heating chamber would have to accommodate the larger leads; and, second, the present device must maintain the industry standard, universal 510 threading system which will not accommodate the larger wire leads without changing the overall size of the portable device. The present invention solves the two issues by using a large coil with the natural larger leads, and clipping off those small gauge leads and welding or soldering on large gauge leads. The introduction of having large gauge leads than the leads that are already the extension of large coils allows for smaller lead holes though the ceramic heating chamber which reduces the likelihood of leakage which would a short within the device, which is another safety feature. The combination of a small gauge coil with large gauge leads welded on, a narrowed ceramic heating chamber, and the conjunctive airflow base, produces more vapor and flavor at any temperature.

The enhancement of reducing the size of the lead wires of the coil allows the present invention to increase the size of the coil. In the art, producers of atomizers are not able to use larger coils as the leads are too large to fit in the industry standard, universal 510 thread system. Wire leads that are too large would reduce the thickness of the insulator that separates the positive and negative leads not allowing for a safe connection. Consequently, the process of attaching large gauge wire leads to accommodate the industry standard, universal 510 thread system while maintaining the thicker insulator, greatly reduces the risk of one of the wire leads melting the insulator and creating an electrical short.

BRIEF DESCRIPTIONS OF THE DRAWINGS

FIG. 5 is a sectional view of the replacement atomizer component displaying the component distribution of the current embodiment of the present invention.

FIG. 6 is a perspective view of the heating coil and heating rod located within the ceramic heating chamber of the replacement atomizer body of the present invention..

FIG. 7 is a perspective view the ceramic heating chamber as viewed from the top of the chamber showing the configuration of the placement of the two smaller exit holes for the wire leads from the heating coil and the larger holes for air intake in the current embodiment of the present invention.

FIG. 8 is a perspective view of the ceramic heating chamber as viewed from the bottom showing the configuration of the placement of the two smaller exit holes for the wire leads from the heating coil and the two larger holes for air intake of the current embodiment of the present invention.

Figure 11:
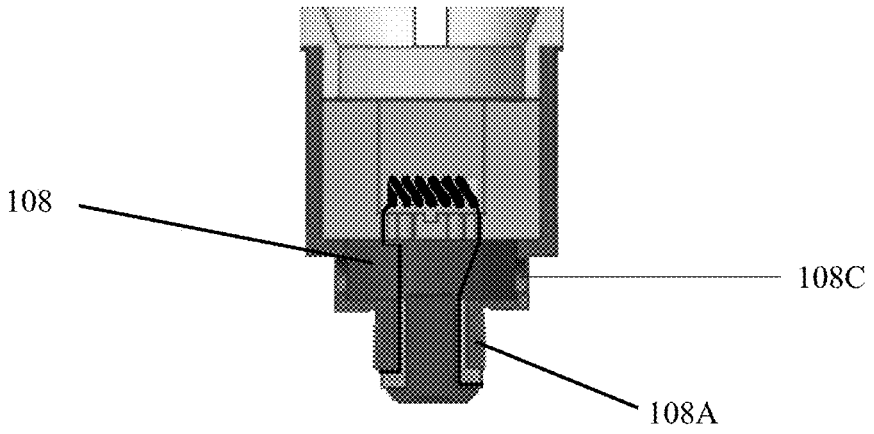
Figure 11:
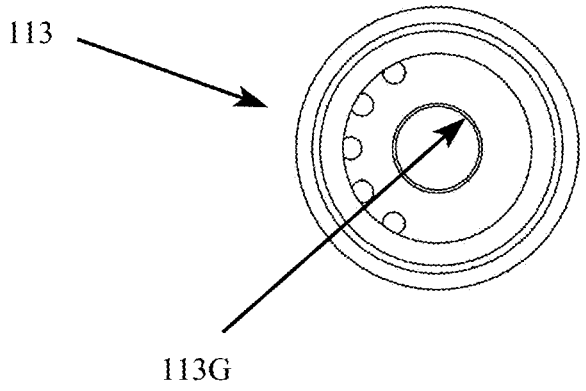

FIG. 9 and 10 are perspective views of the heating coil pertaining to the process of reducing the size of the gauge of the wire leads coming from the heating coil of the present invention FIG. 11 is a view of the replacement atomizier as it pertains to connection to the conjunctive airflow base a sectional view of the replacement atomizer component's industry standard, universal 510 male threads by which they are joined to the corresponding 510 female threads of the conjunctive airflow base of the present invention .

Figure 12:
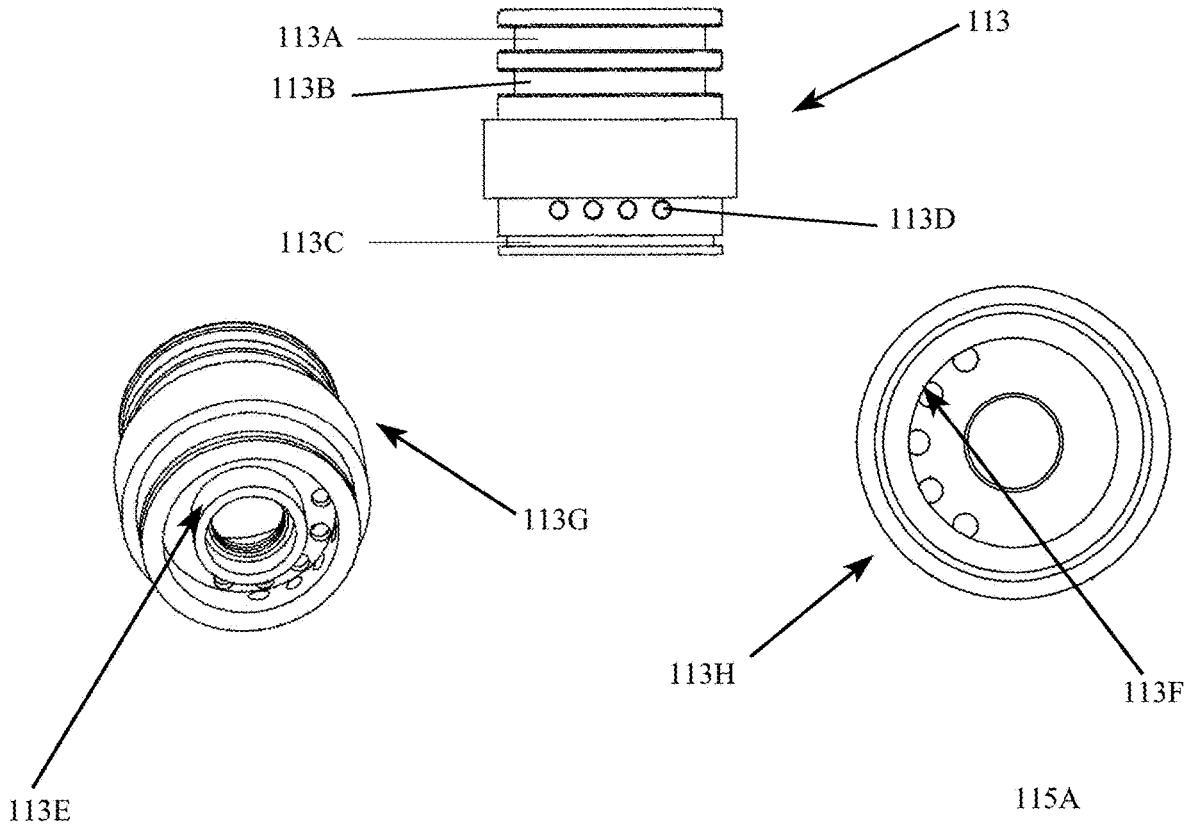

FIG. 12 is three perspective views of the conjunctive airflow base component of the present invention.

Figure 13:
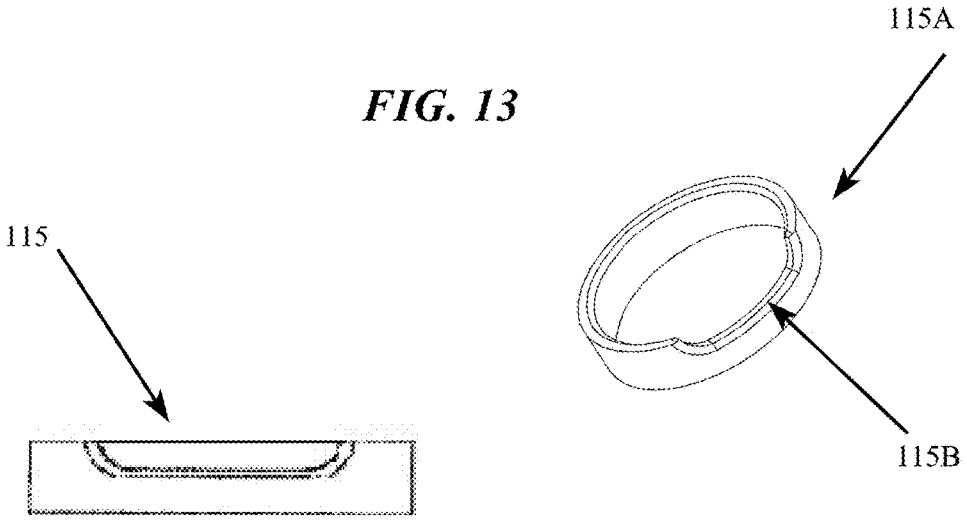

FIG. 13 are two perspective views of the adjustable air ring that rotates around the conjunctive airflow base holes to adjust incoming ambient air in the present invention.

Figure 14:
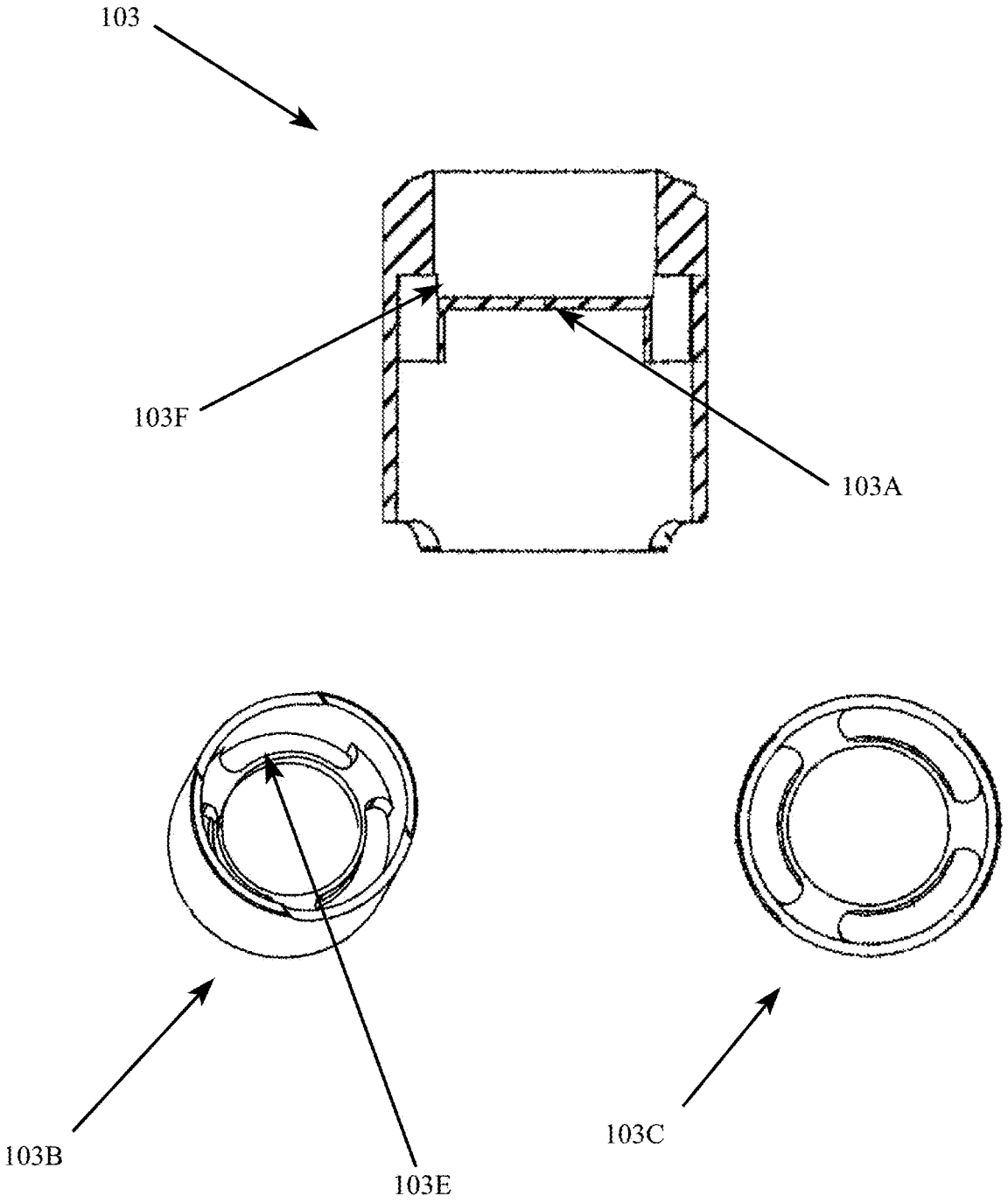

FIG. 14 are several perspective and sectional views of the reclaim safety cap of the present invention.

FIG. 15 is a perspective view of the mouthpiece and the groove for the o-ring and the o-ring of the present invention..

FIG. 16 is the components of the 510 deck and the points of connection to the conjunctive air flow base.

Figure 17:
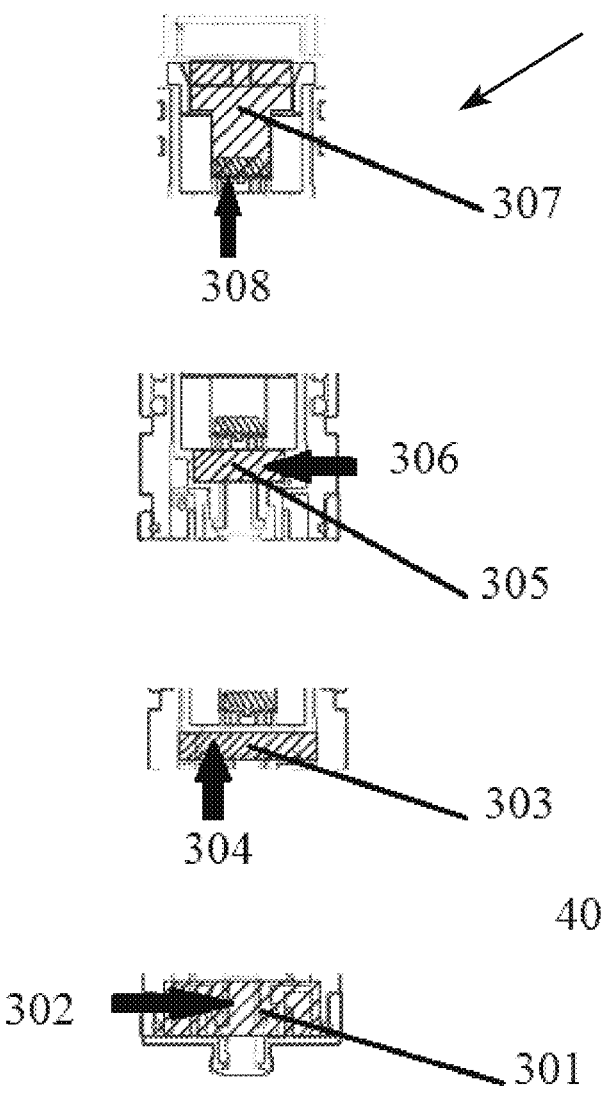

FIG. 17 is sectional view of an airflow diagram showing the operative state of the the entry of ambient air through each chamber of the component through to the base of the replacment atomizer body in the present invention.

Figure 18:
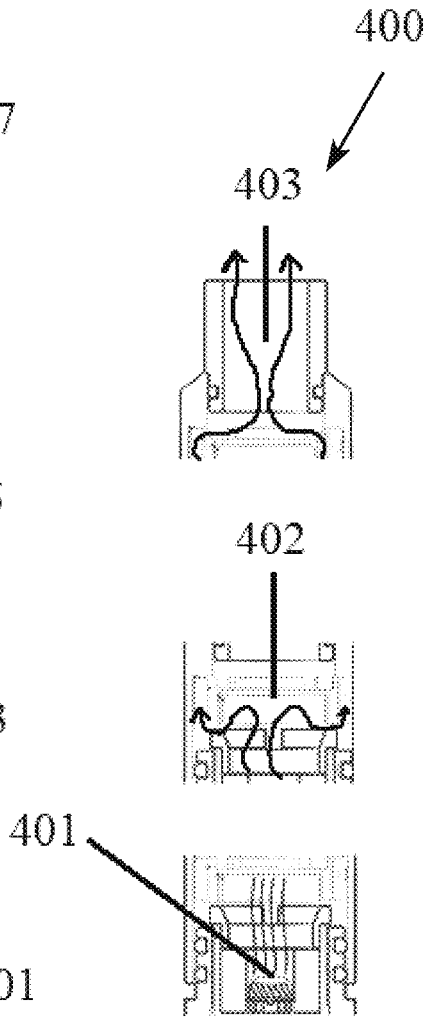

FIG. 18 is sectional view 2 of an airflow diagram showing the activated state of the air and subsequent vapor flow once the substance has been applied to the heating coil in the present invention.

Figure 19:
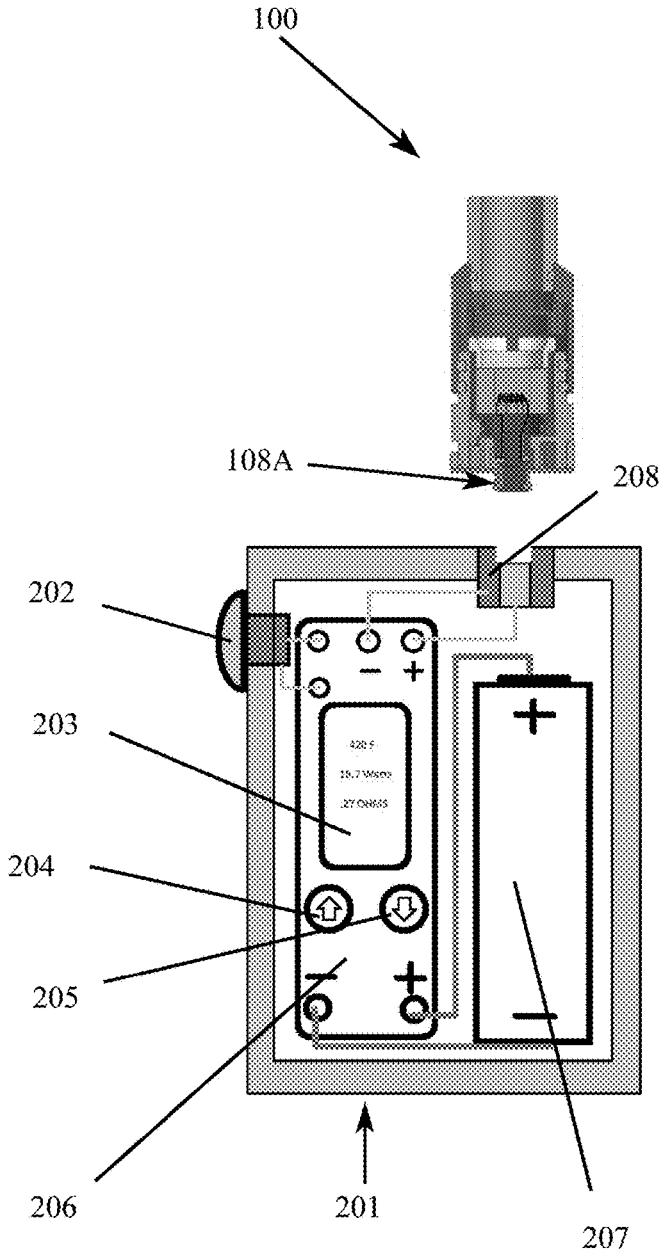

FIG. 19 is a sectional view of the present invention and the position of the present invention relative to a typical regulated power source including the components of a typical power source.

Figure 20:
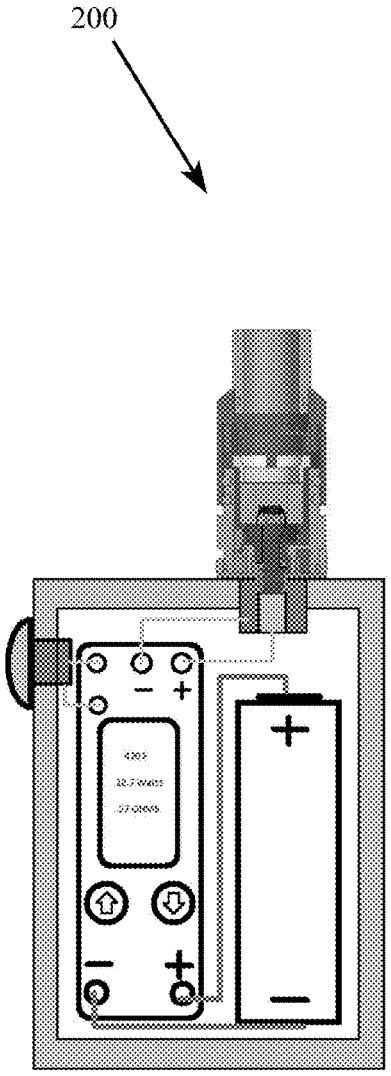

FIG. 20 is a sectional view of the present invention after it is has been attached by the universal, industry standard 510 threaded connection to the regulated power source.

DETAILED DESCRIPTIONS OF THE DRAWINGS

All illustrations of the drawings are for the purpose of describing selected versions of the present invention and are not intended to limit the scope of the present invention.

Figure 1:
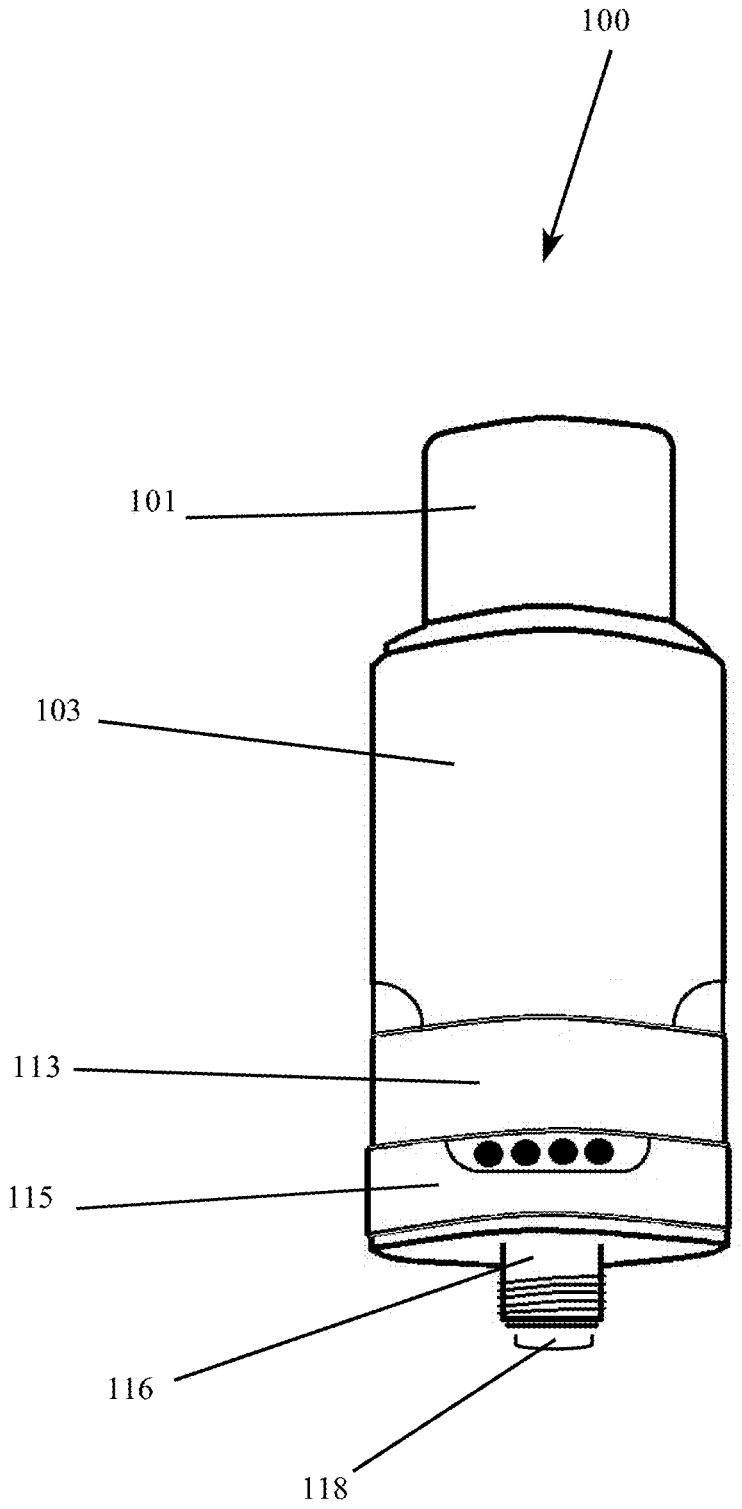
FIG. 1 is a perspective view displaying the device in the assembled configuration as per the current embodiment of the present invention.

Referencing FIG. 1 the present invention is a portable vaporization device 100 that attaches by a universal, industry standard 510 threaded connection 116 to an electrical power source designed to be compatible with atomizers. The device as pictured comprises a mouthpiece drip tip 101, a reclaim safety cap 103, a conjunctive airflow base 113, an adjustable air ring 115, a universal 510 threaded base 116, and a positive metal pin 118.

Figure 2:
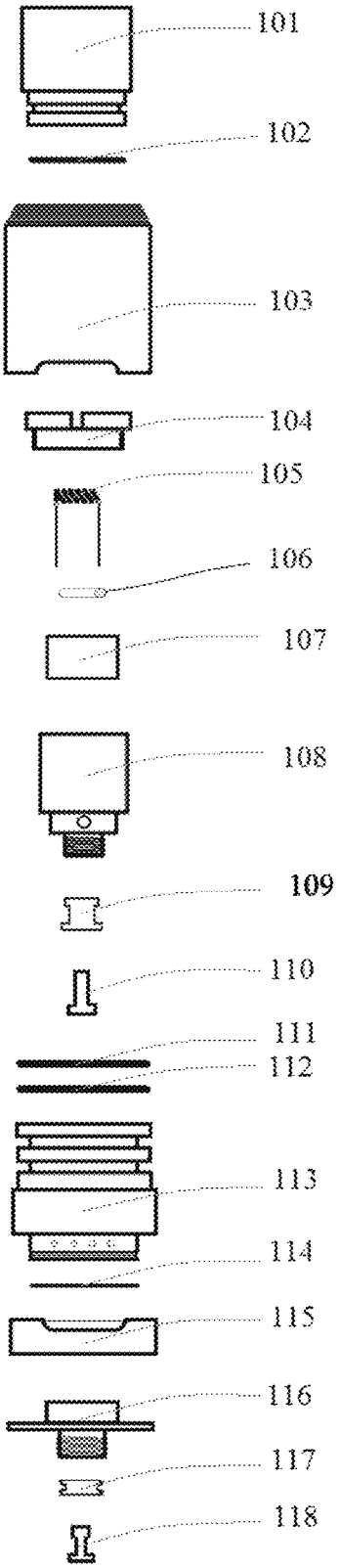
FIG. 2 is perspective sectional view displaying the arrangement of each component of the present invention.

Referencing FIG. 2 the components of the present invention are shown individually. The mouthpiece drip tip 101 consists of an o-ring groove (FIG. 14, 101A) to accept the o-ring 102, and is then inserted into the reclaim safety cap 103. The heating coil 105 holds the heating rod 106, which are disposed in the ceramic heating chamber 107. These components are placed into the replacement atomizer body 108 and secured in place with the safety ring 104. The ceramic heating chamber 107 functions as the component that retains the desired substance. An insulator 109 is inserted by friction fit in the interior wall of the exterior threads of the replacement atomizer body 108 and a positive metal pin 110 is attached by friction fit inside the insulator 109. The conjunctive airflow base 113 accepts the assembled replacement atomizer body 108 through a threaded connection (FIG. 10, 120) located within the center of the conjunctive air flow base 113. The conjunctive airflow base consists of two o-ring grooves (FIG. 12, 113C & 113D) in the upper section that hold the o-rings 111 and 112. The third o-ring groove located at the bottom section of the conjunctive airflow base (FIG. 12, 113E) accepts an o-ring 114 to secure the adjustable air ring 115. The conjunctive airflow base is assembled by friction fit to the 510 threaded deck 116 to keep the adjustable air ring in place. A rubber insulator 117 is inserted in the interior wall by the universal 510 thread system, and a positive metal pin 118 is inserted by friction fit into the insulator 117 which is inserted by friction fit into the 510 threads (FIG. 3, 121).

Figure 3:
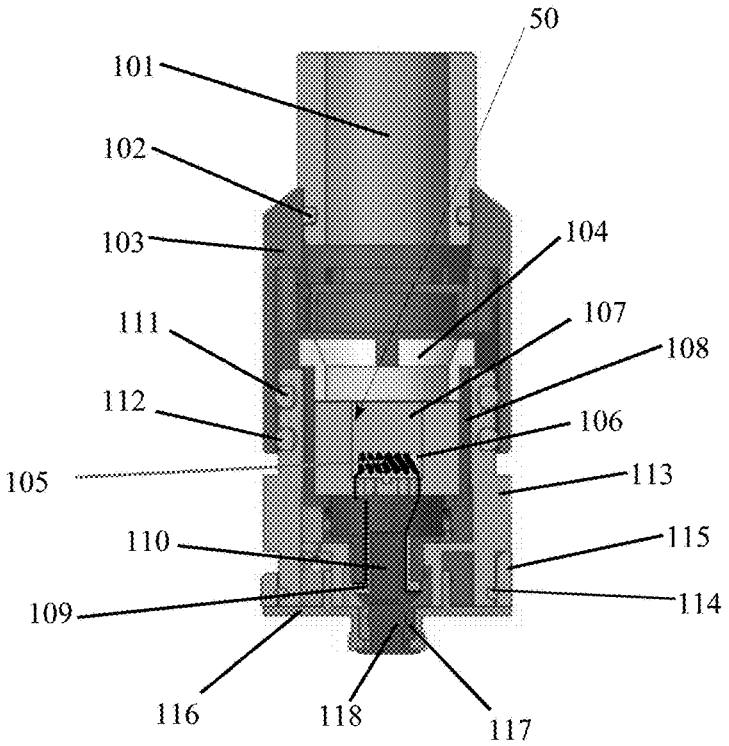
FIG. 3 is a sectional view of the conjunctive airflow atomizer displaying the positioning of the components in the present invention.

Referencing FIG. 3 the interior view shows the position of the each component of the present invention. Beginning with the mouthpiece drip tip 101 which contains a groove to hold an o-ring 102 so that it may be disposed on the reclaim safety cap 103. The reclaim safety cap is connected by an first o-ring 111 with friction fitting, and a second o-ring 112 located on the conjunctive airflow base 113. The replacement atomizer body 108 which consists of a ceramic heating chamber 107, a heating coil 105, a heating rod 106, and a safety ring 104, and an insulator 109, and a positive metal pin 110. The replacement atomizer body (FIG. 4) is secured by male threads (FIG. 5, 121) to the conjunctive airflow base 113 by a threaded connection 119. The conjunctive airflow base 113 comprises an o-ring 114 to secure the adjustable air ring 115 in place when the adjustable air ring 115 is rotated. The universal 510 threaded deck 116 is assembled by friction fit to the conjunctive airflow base 113 to provide an air-tight seal. The universal 510 threaded deck consists of machined threads into which an insulator 117 and positive metal pin 118 have been fitted by friction in the interior wall of the threads. The replacement atomizer body 50, which is removable and replaceable, is shown in detail in FIG. 4.

Figure 4:
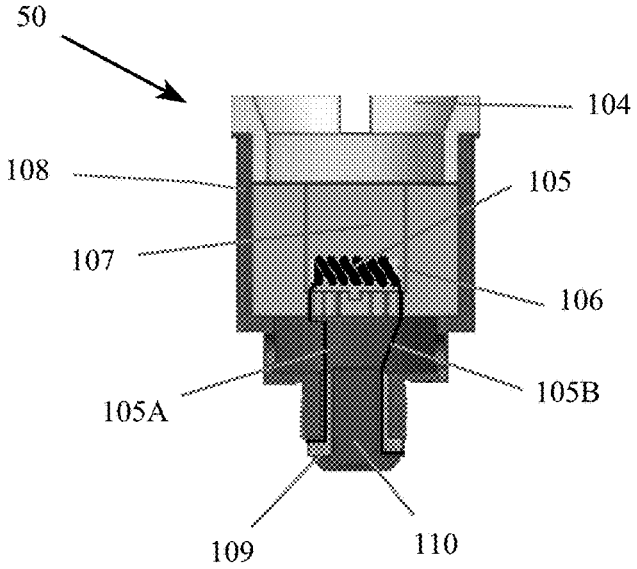
FIG. 4 is a sectional view of the replacement atomizer body displaying the internal component distribution in the assembled configuration of the present invention.

Referencing FIG. 4 the replacement atomizer body 50 is detailed and comprises a heating coil 105, a heating rod 106, a coil lead 105A and a coil lead 105B that exit the ceramic heating chamber 107 via two holes in the the bottom of the ceramic heating chamber (FIGS. 7, 107 A & 107B). Lead wire 105A is inserted between the replacement atomizer body male threads 119 and the insulator 109. Lead wire lead 105B is inserted between the insulator 109 and the positive metal pin 110.

Referencing FIG. 5, a sectional view of the replacement atomizer body (FIG. 5, 50) is shown. The replacement atomizer body comprises the ceramic heating chamber 107, the heating coil 105 and within the heating coil 105 is a heating rod 106. Welded to the heating coil 105 are lead wires 105A and 105B which are a larger gauge than the heating coil 105 so that they can be inserted into the holes (FIG. 7, 107A & 107B) of the ceramic heating chamber 107. Lead wire 105A is inserted between the replacement atomizer body male threads 108A and the insulator 109. Lead wire lead 105B is inserted between the insulator 109 and the positive metal pin 110.

Referencing FIG. 6 the heating coil 105 consists of wire leads and a heating rod 106 which is inserted into the center of the heating coil 105. The location of the friction fit of the safety ring 104A and the replacement atomizer body 108B is shown.

Referencing FIG. 7, a perspective top view of the ceramic heating chamber 107 is shown. 107A displays the placement of the lead wire exit holes and 107B displays the placement of the larger air intake holes within the narrowed section of the ceramic heating chamber.

Referencing FIG. 8, a perspective view of the bottom of the ceramic heating chamber 107 is shown. 107A shows the placement of the lead wire exit holes and 107B shows the two larger holes for the exhaust from the coil 105.

Referencing FIGS. 9 and 10, the heating coil 105 conversion is shown. A small gauge coil 105A is acquired and the two leads are shortened 105B. Larger gauge lead wires 105D are acquired and a welding material 105C is applied to the shortened small gauge coil leads resulting in the design of the present invention 105. Once the restructured coil is complete 105, a heating rod is inserted into the coil 105E.

Referencing FIG. 11 the replacement atomizer is shown relative to it's conneciton to the conjunctive airflow base. The replacement atomizer body 108 comprises two holes 108C to receive incoming air from the holes in the conjunctive airflow base 113. The said 510 male threads 108A of the replacement atomizer body connect to the corresponding said 510 femal threads 113G of the cojutive airflow base.

FIG. 12 shows several view of the features of the conjunctive airflow base 113 are shown. View 113 is a perspective view of the side of the conjunctive airflow base showing the 3 grooves for corresponding o-rings 113A, 113B, 113C. The top two o-rings 9 FIG. 2, 111 and 112) when inserted into the conjunctive airflow base 113 seat the reclaim safety cap (FIG. 2, 103). 113G is a perspective view from a side and bottom of the conjunctive airflow base 113. 113H is a view of the top of the conjunctive airflow base 113. The plurality of holes 113B are shown in the conjunctive airflow base.

Referencing FIG. 13, displays two perspective views of the adjustable air ring 115A side view and 115B, a top side view showing the notch that will cover or leave open any number of air holes.

Referencing FIG. 14, several views of the reclaim safety cap are shown. View 103A is an interior view of the recess cup inside of the cap which is designed to capture heated substances before they reach the user's mouth. View 103B shows a perspective of the reclaim safety cap where three openings are placed around the perimeter of the cup to allow vapor to escape to the user's mouth, but not the substance. View 103C is a second perspective view of the reclaim safety cap showing the recess cup and the three openings surrounding the recessed cup.

Referencing FIG. 15, a perspective view of the mouthpiece 101 is shown. The o-ring groove is shown 101A where the o-ring 102 is inserted to seat the mouthpiece into the reclaim safety cap (FIG. 2 103).

Referencing FIG. 16, the components of the 510 threaded deck (FIG. 2, 116) are shown. . The said 510 threaded deck 116 is friction fitted to the conjunctive airflow base 113. The attachment of the conjunctive airflow base to the 510 threaded deck is shown in 116A and the location of 116B shows the seal that is formed when the two components are connected.

Referencing FIG. 17, the arrangement of the segments of the present invention demonstrates the conjunctive airflow process 300 through each stage to the point of vaporization of the present invention. These operative states comprise the steps of incoming ambient airflow entering 301 through a plurality of holes 302 where it is conditioned, either heated or cooled, and enters the upper chamber 303 through a plurality of holes 304 where it is conditioned a second time and the air is then drawn inward to the replacement atomizer body (FIG. 5, 108A) through a plurality of holes 306, and then the air is directed into the ceramic heating chamber 307, through a plurality of holes 308 through the air intake holes in the ceramic heating chamber.

Referencing FIG. 18. The activated state 400 occurs once a substance is applied to the heating coil 401 and the coil is heated and the vapor and the reclaimable splatter rises to the reclaim safety cap 401 where the vapor is then directed around the reclaim safety cap 402 and the vapor escapes through the slots around the reclaim safety cup and out through the mouthpiece 403 and inhaled by the user.

Referencing FIG. 19, the present invention 100 is shown prior to being coupled to a regulated electrical power source 201 so that the heating coil contained herein is electrically engaged with the electrical power source. The Regulated Power supply box 201 comprises a 3.7 V battery 207, a regulated power controller 206, power up 204 and power down 205 controls, a electrical current setting digital display 203, the fire button 202, and a universal 510 female threaded connection 208.

Referencing FIG. 20. The present invention, 100 is shown in the connected state 200 when connected by a threaded engagement for coupling to the regulated power source (FIG. 18 201) by a male threaded connection (FIG. 18 208) so that the current embodiment of the present invention will effectively heat the coil and therefore vaporize the substance.

DETAILED DESCRIPTION OF THE INVENTION

The device comprises several sections manufactured of one or more materials. In the present embodiment the device comprises detachable sections for cleaning and the replacement of parts which may be susceptible to wear. In the preferred embodiment, the replacement atomizer coil is replaceable by changing the replacement atomizer body, and the o-rings may need to be replaced.

The outer body is designed so that the user has access to the interior parts. In the present embodiment the user has access to the heating coil in order to apply the concentrate. In the preferred embodiment, the user has access to sections of the device to allow the user to clean the parts that accumulate residue and replace components. In the present embodiment, the sections include the mouthpiece drip tip secured by a friction fitted o-ring; the reclaim safety cap secured by two friction-fitted o-rings on the conjunctive airflow base; and a replacement atomizer comprising the atomizer body comprising a 510 male threaded connection in the base, a non-conductive cup shaped structure narrowed on two interior sides and comprises exit holes for the coil wire leads and intake air holes and which holds the heating coil and heating rod, which are assembled by friction fit to a safety ring. In the interior of the male threads of the replacement atomizer, there is a positive metal pin fitted assembled by friction fit into an insulator also assembled by friction fit; the conjunctive airflow base which is assembled by friction fit to the 510 male threaded deck and within the interior wall of the threads are the positive metal pin and insulator which are fitted by friction. The replacement atomizer body's positive metal pin makes contact with the positive metal pin located within the threads of the industry standard, universal 510 deck.

In current art as in the present embodiment, 510 male threads denote a threaded stem located at the center of the base of the atomizer that allows the user to attach the device to universal threads on a regulated power source containing the female receiver section. The outside of the 510 connector threads of the replacement atomizer body act as the ground or negative pole of the circuit and each center positive metal pin acts as the positive connection. On each male and female section of the 510 threads there are corresponding components When the device is connected by the universal 510 male threads to the female threads of a regulated power source, the user's hand holds the regulated power source. A compatible regulated power source is defined as one that contains the female threads to accept the 510 male threaded connection of the present device. As to power supply, a conventional or readily available power supply is made by LostVape Company, and the chipset within the power supply unit is manufactured by several companies, among the best known is EVOLV. The regulated power supply unit comprises a 3.7 volt rechargeable battery; a fire/power button; power and temperature setting controls and a regulated power controller. regulated power source temperature settings.

In the preferred embodiment, the device may be constructed of steel which is a metal known to retain heat in the interior while maintaining a thermally non-conductive temperature on the exterior. In other embodiments materials that retain heat while maintaining a cool exterior may be used such as ceramic, coated metals, and composites. The material used in the present embodiment is selected for its durability and ability to maintain temperature internally so that it does not convey the heat to the outside surface of the device.

In the present embodiment, the device comprises a detachable mouthpiece drip tip, from which the user draws the vapor. The mouthpiece drip tip through which the vapor flows when the user places his mouth around the opening and by inhaling or drawing as the vapor passes from the heating coil around the slots of in the reclaim safety cap and into the user's mouth. In the present embodiment, the mouthpiece drip tip comprises openings at the top and bottom, which promote air flow from the interior of the device. The vapor produced is the primary purpose of the device disclosed herein. The mouthpiece drip tip is an exterior aspect of the device and is seated by an o-ring when inserted into the reclaim safety cap. The o-ring may be manufactured of rubber or silicone or other insulating materials In the present embodiment, the mouthpiece drip tip contains a groove in the bottom portion for an o-ring to secure the mouthpiece drip tip into the top of the reclaim safety cap.

In the present embodiment, the device comprises a reclaim safety cap, which contains a sufficient number of slots concentrifically placed inside the perimeter of the recessed cup and suspended by three arms so as to permit the vapor, but not solid matter, to pass through to the mouthpiece drip tip and into the user's mouth when inhaling. In the present embodiment, the device comprises a recessed cup within the reclaim safety cap so that it may capture the splatter from heating concentrate from the heating coil. In the preferred embodiment, the reclaim safety cap separates from the other parts of the device in order for the user to chill and bring down the temperature of said reclaim safety cap in order for the users who have breathing issues to further achieve a cooler vapor and works in conjunction with the pre-cooling of the conjunctive airflow base. The reclaim safety cap is seated by two o-rings when disposed on the conjunctive airflow base. The o-rings may be manufactured of rubber or silicone.

In the present embodiment, the replacement atomizer body comprises the following components: a heating coil with welded leads, a heating rod inserted into the coil; a ceramic heating chamber; a 510 threaded male connection in the base; a safety ring to secure the contents within the replacement atomizer body, an insulator, and a metal pin. The body of the replacement atomizer has two air inlet holes slightly recessed located above the said threaded connection.

The reader should note that there are two threaded connections contained in the device. One threaded connection is contained in the 510 deck which houses the conjunctive airflow base of the present device and the second threaded connection is contained in the replacement atomizer body. The outside male threads in the 510 deck of the conjunctive airflow base of the present device connect to compatible female threads of a regulated power source.

In the present embodiment, in the event of failure of the heating coil from overuse, high temperatures, or electrical bursts, the replacement atomizer is removable and can be replaced with a proprietary replacement atomizer manufactured to fit the configuration of the present device.

In the present embodiment, a safety ring is installed and fitted by friction on the top of the replacement atomizer body for the final assembly to hold the heating coil and ceramic heating chamber securely in place.

In the present embodiment, the function of the positive and negative connection is to complete the electrical circuit from the regulated power source up and into the heating coil of the present device. Positive pins within the interior wall of the exterior threads of the replacement atomizer and 510 deck all have the same function which is to allow the flow of current from the regulated power source to a heating coil.

In one embodiment, the heating wire is tightly wound to form a coil and a heating rod is inserted in the heating coil. In the preferred embodiment, the heating rod is constructed of quartz crystal which is more of an inert material which means substances burn cleaner and which improves the flavor of the vapor. The heating coil consists of two wire leads which complete the negative and positive electrical circuit.

The heating coil converts electrical energy into heat. Vaporizing substances requires both sufficient heat and airflow. The size of the heating coil and the amount and temperature of the airflow determine the amount of vapor produced, e.g., the larger the heating coil surface and the greater the airflow, the greater the production of vapor. The heating coil which has two wire leads welded to the ends of the coil, passes through two holes in the ceramic heating chamber. The heating coil should be capable of heating to temperatures of above 400 degrees Fahrenheit.

In the preferred embodiment, the heating coil is constructed of single wire or a plurality of wires of varying shapes is tightly wound around a rod in the shape of the heating rod into a coil shape and may be constructed out of any conductive material such as kanthal wire, stainless steel, nickel, titanium, ceramic, or a composite metal wire suitable to vaporize substances applied directly to the heating coil at regulated temperatures.. In the present embodiment, the coil is reconstructed. The reconstructed two coil leads from each respective end of the heating coil are inserted into one of the two exit holes of the ceramic heating chamber. The wire leads from the heating coil make contact with a positive metal pin located in the base of the replacement atomizer and the atomizer body threads.

In the present embodiment, the replacement atomizer body comprises a heating coil surrounding a quartz rod, but not limited to that material. Inserted into the center of the heating coil and used to create more heating surface when installed into the heating coil.

In the preferred embodiment, the ceramic heating chamber is narrowed on two sides of the interior of the cup-like structure. In the preferred embodiment, in the bottom inside of the ceramic heating chamber, there are four holes, each hole surrounded by a raised surface to inhibit the concentrate from leaking through the four holes. In the preferred embodiment, the two small outer holes are for the leads of the heating coil and the two inner larger diameter holes are to accommodate the air flow directly underneath the heating coil. In the preferred embodiment, the larger air intake holes manipulate the coil temperature and force the vapor into the reclaim safety cap.

In the present embodiment, the positive metal pin located in the said 510 thread system of the replacement atomizer body is a conductive metal, sometimes gold plated, silver or copper material, and part of the industry standard to fit an industry standard, universal 510 threaded system.

In the preferred embodiment, the purpose of the insulator located within the interior of the threads is to separate the negative and positive leads from the coil. One lead is inserted into the center of the insulator while the other lead is inserted on the outside of the insulator. In the present embodiment, as in current art, the insulator is inserted into the interior wall of the universal, industry standard 510 threaded opening and secured by friction fitting, and when the positive metal pin is inserted by friction fitting, the insulator keeps the positive metal pin secured in place and forces the center lead wire up against the positive metal pin and the outside of the insulator is pressing the other lead onto the atomizer body which is the negative connection.

In the present embodiment, the conjunctive airflow base is the main section having a plurality holes on the side of the lower part of the base which fills up the first chamber with ambient air for the air to be conditioned. Then there are a plurality of holes above in the second chamber where the air comes in and changes direction from the first chamber. The inner wall in the second chamber where the air comes in is slightly recessed and the inner holes are up against that recess wall so it's forcing the air to interact with the metal as much as possible to condition it before changing direction and going to the two holes in the replacement atomizer.

In the present embodiment, the air inlets located on the side of the exterior of the conjunctive airflow base are covered by an adjustable air ring that rotates 360 degrees around the conjunctive airflow chamber air inlets to regulate airflow based upon user preference. Once the desired air flow is achieved, the adjustable air ring is held in place by an o-ring. The adjustable air ring is held in place by the said 510 deck which is friction fitted to the conjunctive airflow base.

In the present embodiment, incoming airflow may be incrementally stepped up or reduced so that a user may adjust the quantity of incoming ambient air based upon personal preference by rotating the adjustable air ring. The airflow is determined by whether the user selects to expose to expose a plurality of holes. In the present embodiment, by selecting a lesser number of holes, the user is constricting the flow of incoming ambient air providing less air into the conjunctive airflow chamber. The selection of a lesser number of openings produces less air flow, and thus a hotter vapor. Allowing in more ambient air by selecting a greater number of open holes, provides a cooler vapor. The adjustable air ring in the present embodiment is what enables a user to achieve the desired temperature, combined with the the regulated power source settings for the temperature of the coil.

In the present embodiment, a user may prefer additional incoming ambient air due to lung sensitivity issues such as C.O.P.D, and an increased airflow produces a cooler vapor. A user who prefers what is known as a hotter vapor may adjust the incoming air inlets on the outside to limit the incoming air from 1 holes open at one time to a plurality of open holes. Airflow is required to bring vapor to the user's mouth and also to keep the substance and the coil from overheating. The present embodiment permits the user to adapt airflow quantity and temperature of the vapor to their needs.

The present embodiment enables users with sensitive lung issues to inhale a cooler vapor. Water pipes are still commonly used to cool the combustible substance and dry herb where the user could add either water or water and/or ice. The present embodiment is designed to have a means to condition the air before it reaches the coil. In the preferred embodiment, this device enables the user to cool or pre-chill the conjunctive airflow chamber without adversely affecting the heating coil. In the present embodiment, the user may separate the conjunctive airflow base and the reclaim safety cap from the other parts and place them near a cooling source, e.g., air conditioner, refrigerator or freezer in order to chill the interior air space of the conjunctive airflow base. The reclaim safety cap when chilled also enhances the cooling of the vapor because the reclaim safety cap has a suspended recessed cup above the coil which restricts the air from going directly through to the mouthpiece and causes it to wrap around the outer perimeter of the reclaim safety cup and is further chilled as it goes up and through the thin slots and comes up through the mouthpiece drip tip to the user's mouth to continue inhaling.

In the present embodiment, there is an o-ring groove located at the bottom of the Conjunctive airflow base to secure the adjustable air ring in place The o-ring is located below the plurality of air inlet holes on the side of the conjunctive airflow base where there is a corresponding groove to hold the o-ring Once the conjunctive airflow base and the o-ring and the adjustable air ring are in place, the said 510 deck is fitted by friction to the bottom of the conjunctive air flow base keeping the air ring secured to the device and said o-ring keeps the adjustable air ring securely in place once the user rotates the adjustable air ring to desired air flow.

In the present embodiment, the upper air chamber of the conjunctive airflow base comprises female 510 threads to accommodate the installation of the corresponding 510 male threads of the replacement atomizer body, which completes the second conjunctive airflow section through two recessed air inlets located in the replacement atomizer body.

In the present embodiment, placed at the the top section } of the said 510 threaded deck is a round convex fitting that friction fits to the round convex fitting in the lower part of the conjunctive airflow base. In the present embodiment, stainless steel is used. In the present embodiment, the said 510 deck comprises an insulator, fitted by friction into the interior wall of the male threads of the 510 deck, and the positive metal pin is inserted, fitted by friction into the center of said insulator.

What is claimed is:

1. A conjunctive airflow atomizer for concentrates comprising: a mouthpiece drip tip; a reclaim safety cap; a replacement atomizer module; a conjunctive airflow base; an industry standard universal 510 threaded deck; wherein said mouthpiece drip tip comprises an O-ring groove to accept a fitted O-ring, wherein said mouthpiece drip tip is inserted into said reclaim safety cap, and is seated by said O-ring; wherein said reclaim safety cap comprises a plurality of interior concentric vent holes adjoining a recessed cup-like structure, wherein said reclaim safety cap is disposed on said conjunctive air flow base; wherein said conjunctive airflow base comprises three O-ring grooves to accept two upper O-rings and one lower O-ring; wherein said reclaim safety cap is seated on said conjunctive airflow base by the two upper O-rings, wherein an adjustable air ring is seated by said one lower O-ring; wherein said adjustable air ring is disposed on an end of the conjunctive airflow base by friction fit and is secured to said industry standard universal 510 threaded deck by friction fit; wherein said replacement atomizer module fits within said conjunctive airflow base; wherein the replacement atomizer module comprises: a ceramic heating chamber, a heating coil comprising welded wire leads, a heating rod disposed within said heating coil, an industry standard universal 510 male threaded connector, and a positive metal pin for conducting electricity; said positive metal pin sheathed by an insulator inserted in the center of said industry standard universal 510 male threaded connector; wherein said ceramic heating chamber comprises a round cup-like structure narrowed on two interior opposing sides, said ceramic heating chamber comprising a plurality of holes, said ceramic heating chamber being concentrically situated within said replacement atomizer module, wherein a safety ring is secured to an end of the replacement atomizer module; said safety ring comprising a threaded connection; wherein the conjunctive airflow base comprises two chambers with a plurality of exterior and interior holes; wherein said conjunctive airflow base comprises an interior industry standard universal 510 female threaded connection to accept said industry standard universal 510 male threaded connector of said replacement atomizer module; wherein said conjunctive airflow base is disposed by friction fit on to said industry standard universal 510 threaded deck.

2. The conjunctive airflow atomizer of claim 1, wherein the reclaim safety cap comprises a plurality of interior holes being circumferentially positioned around said recessed cup-like structure permitting vapor to rise while blocking heated substances from reaching a user's mouth.

3. The conjunctive airflow atomizer of claim 1, wherein said reclaim safety cap comprises said recessed cuplike structure to capture an un-used heated substance.

4. The conjunctive airflow atomizer of claim 1, wherein said replacement atomizer module is removable and replaceable by said industry standard universal 510 male threaded connector.

5. The conjunctive airflow atomizer of claim 4, wherein the heating coil comprises one positive terminal lead and one negative terminal lead, wherein said wire leads have been reconstructed by removing said existing wire leads and attaching a wire of a gauge size larger than said heating coil gauge to accommodate both the exit holes of the ceramic heating chamber and to fit the space between said positive metal pin and said insulator contained within said industry standard universal 510 male threaded connector.

6. The conjunctive airflow atomizer of claim 5, wherein the negative terminal is inserted between the insulator in the interior wall of the industry standard universal 510 male threaded connector and the positive metal pin, and the positive terminal being inserted between said insulator and the positive metal pin, wherein electrical current is allowed to flow when connected to the positive metal pin of the conjunctive airflow base, after connecting the atomizer to a regulated power source.

7. The conjunctive airflow atomizer of claim 1, wherein the ceramic heating chamber has a narrowed interior on two sides constraining an applied substance within the ceramic heating chamber.

8. The conjunctive airflow atomizer of claim 1, wherein ambient air is permitted to flow through the plurality of holes of the conjunctive airflow base through a lower chamber then an upper chamber of the two chambers, and subsequently into the replacement atomizer module through said plurality of holes disposed beneath said heating coil contained in said ceramic heating chamber.

9. The conjunctive airflow atomizer of claim 8, wherein the air flows from the conjunctive airflow base up to the replacement atomizer module to the mouthpiece drip tip through said reclaim safety cap.

10. The conjunctive airflow atomizer of claim 1, wherein rotating the adjustable air ring around the plurality of holes in the conjunctive airflow base allows a number of openings to be selected for incoming ambient air.

11. The conjunctive airflow atomizer of claim 1, wherein electrical current from a regulated power source makes contact with said positive metal pin in said industry standard universal 510 threaded deck.

12. A method of converting concentrates, semi-solid substances, and dry herbs into a vapor using said conjunctive airflow atomizer of claim 1, comprising the steps of: a) removing said mouthpiece drip tip; b) removing said reclaim safety cap; c) accessing said heating coil chamber in said replacement atomizer module; d) applying a substance or a concentrate directly onto said heating coil; e) replacing said reclaim safety cap; f) replacing said mouthpiece drip tip; g) setting the number of holes open for airflow by rotating said adjustable air ring in said conjunctive airflow base; h) connecting said conjunctive airflow atomizer to a regulated power source by means of said threaded connection in the industry standard universal 510 threaded deck of said conjunctive airflow base, said regulated power source having a regulated thermostat; i) setting the temperature of the regulated power source thereby actuating the heating so that said heating coil attains sufficient levels to vaporize said substance or concentrate; and j) drawing a breath through said mouthpiece drip tip so that conditioned air is mixed with the heated and vaporized substance and drawn through and out of the mouthpiece drip tip.

13. The method of claim 12, further comprising the step of placing the conjunctive airflow base and the safety reclaim cap in a refrigerator or a freezer.

14. A method of controlling the quantity and temperature of vapor output from the conjunctive airflow atomizer of claim 1, comprising adjusting the amount of ambient air entering said conjunctive airflow base by utilizing said adjustable air ring to select the desired number of open holes which draws in and redistributes air in said lower chamber of the conjunctive airflow base, and draws in and redistributes air in said upper chamber of the conjunctive airflow base, where air is drawn by inhalation through the holes in said ceramic heating chamber comprising the heating coil.

* * * * *